United States Patent [19]

Schmoch

[11] 3,976,399

[45] Aug. 24, 1976

[54] ROTOR OF DISC CONSTRUCTION FOR SINGLE-SHAFT GAS TURBINE

[75] Inventor: Otto Schmoch, Muhlheim-Ruhr, Germany

[73] Assignee: Kraftwerk Union Aktiengesellschaft, Berlin and Munich, Germany

[22] Filed: July 8, 1971

(Under Rule 47)

[21] Appl. No.: 160,832

[30] Foreign Application Priority Data

July 9, 1970 Germany ..... 2034088

[52] U.S. Cl. ..... 416/201 R; 416/198 A

[51] Int. Cl.[2] ..... F01D 5/06

[58] Field of Search ..... 416/198–201, 416/213, 200 A

[56] References Cited

UNITED STATES PATENTS

| | | | |
|---|---|---|---|
| 2,452,782 | 11/1948 | McLeod et al. | 416/201 |
| 2,654,565 | 10/1953 | Feilden | 416/201 |
| 2,869,820 | 1/1959 | Marchant et al. | 416/201 |
| 3,680,979 | 8/1972 | Hansen et al. | 416/199 |

FOREIGN PATENTS OR APPLICATIONS

| | | | |
|---|---|---|---|
| 800,524 | 8/1958 | United Kingdom | 416/199 |

*Primary Examiner*—Everette A. Powell, Jr.
*Attorney, Agent, or Firm*—Herbert L. Lerner

[57] ABSTRACT

Rotor of disc construction for at least single-shaft gas turbines having compressor and turbine stages includes respective rotor disc packages for the compressor and turbine stages, a hollow shaft located between the compressor and turbine stages, and respective shaft stubs seated at the outer ends of the rotor disc packages at respective meshing centering ring gears secured against torsion, all strung together coaxially, and means for clamping the same together including a connecting rod extending centrally therethrough; and tubular intermediate members located between the outer periphery of the connecting rod and the inner periphery of the rotor discs for maintaining elastic contact between the connecting rod and the discs during operation of the turbine, the intermediate members being axially divided shells surrounding the connecting rod, and at least one clamping ring clamping the shells together and bracing them against the outer periphery of the connecting rod.

7 Claims, 4 Drawing Figures

ROTOR OF DISC CONSTRUCTION FOR SINGLE-SHAFT GAS TURBINE

The invention relates to rotor of disc construction for single-shaft gas turbines having compressor and turbine stages and, more particularly, to such rotor including rotor discs for the compressor and turbine stages, a hollow shaft located between the compressor and turbine stages, and respective shaft stubs seated at the outer ends of the rotor disc packages of the compressor and turbine stages at respective meshing centering ring gears secured against torsion, all strung together coaxially to a surrounding rotor drum and clamped together by a suitable clamping device including a connecting or tie rod extending centrally therethrough.

Such a rotor is known from German Petty Pat. No. 1,955,715. In order to permit clamping of the connecting rod or clamping together of the rotor drum, for example by means of tightening nuts threaded on the ends of the connecting rod, at the assembly of such a rotor, a small amount of clearance or play is required between the connecting rod and the rotor discs. As a result of the large bearing play, the natural or characteristic frequency of the connecting rod is far below the rotational frequency of the rotor. The natural frequency varies with the temperatures in the rotor and with the prestressing of the connecting rod which, in turn, is dependent upon the temperature differences in the rotor. The connecting rod can consequently be caused to oscillate during the operation of the rotor, possibly resulting in imbalanced rotation. The problem arises therefrom to so construct the rotor of this general type that, when it is stationary, it is possible to slide the connecting rod and rotor discs mutually relative to one another, but when it is rotating at full rotational speed, however, an adequately rigid contact exists between the connecting rod and the rotor discs.

It is known that shafts and discs of rapidly rotating rotors can be rigidly connected to one another by heat shrinking the discs onto the shafts so that even at full rotational speed, the discs maintain a fixed central seat on the shafts. For the purpose of the invention of this application, such a connection is unsuitable, because mutually relative slideability of the rotor discs and the connecting rod must be provided when the rotor is stationary, while there must be a rigid support of the rotor discs on the connecting rod when the rotor is rotating at full speed.

It is furthermore known, for a gas turbine rotor of disc construction, from Swiss Pat. No. 259,566, to provide, between the outer periphery of the connecting rod and the inner periphery of the rotor discs, tubular intermediate members which serve for maintaining elastic contact between the contacting rod and the discs during the operation of the rotor. These known intermediate members are formed at each end of the shaft, respectively, of at least two compression or tension members disposed coaxially to the connecting rod and which transmit the force of the connecting rod back and forth before the clamping or tensioning force from the shaft stubs is exerted on the rotor disc package, engagement or contact surfaces being provided over the length of the connecting rod and the intermediate members which are slid with a press fit within one another and on the connecting rod. Such construction is relatively costly because the telescoping sleeves of the intermediate members that are inserted in the widened shaft stub bore and the hub bores of the discs require an accurate press fit along a relatively great length thereof and corresponding fine machining as well as a consequently relatively great cost of assembly.

It is accordingly an object of the invention to provide rotor of disc construction for at least single-shaft gas turbine which affords a considerable improvement over the heretofore known rotors of this general type and which more specifically permits sliding of the connecting rod and rotor discs mutually relative to one another when the rotor is stationary yet maintains rigid contact between the connecting rod and rotor discs when the rotor is rotating at full rotational speed.

The invention of the instant application thus stems from the reasoning that in at least single-shaft gas turbines, the connecting rod proper acting as a spring member generally has an adequate length, and the invention has as an objective so to construct the gas turbine rotor of this general type that, as aforementioned, on the one hand, a rigid contact is afforded between the rotor discs and the connecting rod in a relatively simple manner during operation of the rotor and, on the other hand, the assembly of the rotor is possible in an easy and effortless manner due to relative displaceability of the rotor discs and the connecting rod when the rotor is stationary.

With the foregoing and other objects in view there is provided, in accordance with the invention, rotor of disc construction for at least single-shaft gas turbines having compressor and turbine stages, comprising respective rotor disc packages for the compressor and turbine stages, a hollow shaft located between the compressor and turbine stages, and respective shaft stubs seated at the outer ends of the rotor disc packages at respective meshing centering ring gears secured against torsion, all strung together coaxially, and means for clamping the same together including a connecting rod extending centrally therethrough; and tubular intermediate members located between the outer periphery of the connecting rod and the inner periphery of the rotor discs for maintaining elastic contact between the connecting rod and the discs during operation of the turbine, the intermediate members comprising axially divided shells surrounding the connecting rod, and at least one clamping ring clamping the shells together and bracing them against the outer periphery of the connecting rod.

The advantages attainable by the invention are primarily that the axially separated shells widen elastically and in dependence upon cetrifugal force during operation of the rotor so that tight contact is obtained between the rotor discs and the connecting rod. It is possible to determine the degree of compression and the desired degree of damping at the most favorable value by suitably constructing the shells in a simple manner. The cost of construction and finishing of the shells with the clamping ring is relatively low.

It is preferred in accordance with the invention that the clamping ring be secured by heat-shrinking on the shells and the connecting rod. This produces an especially reliable connection because tightening screws and respective safety devices against torsion may be dispensed with. Moreover, the shrink fitted rings provide a very rigid seat for the shells which fill the gap between the connecting rod and rotor discs in the sense of attaining a sliding seat. When the rotor is running at full operating speed, the rigid contact between the shells and the connecting rod is maintained due to the shrink stresses in the clamping rings.

In accordance with another feature of the invention, the clamping ring is provided at each end of the shells. A result thereof is that the shells elastically arch outwardly like barrel staves during operation of the rotor.

In accordance with a further feature of the invention, the intermediate member is formed of two equal shell halves which surround the connecting rod with only a small gap therebetween. A small gap produces little or no leak losses.

In accordance with an additional feature of the invention, the shells extend axially over a rotor disc package made up of a plurality of rotor discs. The narrow oscillation-damping contact between the connecting rod and the inner periphery of the rotor discs can, in this manner, be made sufficiently large. In this regard it is particularly desirable, in accordance with yet another feature of the invention, to dispose the shells substantially over half the length of the connecting rod and in the vicinity of the first rotor discs of the compressor stage facing the turbine stage, i.e. in that part of the length of the connecting rod where the connecting rod would have had the greatest oscillation amplitudes during operation of the rotor if the connecting rod had not been fixed.

In accordance with a concommitant feature of the invention, both ends of the shells project beyond the clamping ring and are surrounded respectively by a rotor disc directly adjacent the clamping ring. When the center region of the shells rises slightly in this manner, due to centrifugal force, both ends of the shells are definitely fixed, which increases the clamping force still further. The elasticity and clamping force of the shells can be further controlled by providing shells greater in number than two shells, which are axially separated from one another, such as three shells, for example. A construction with three similar shells also produces a rotational symmetrical arrangement. The axially separated shells with clamping rings as intermediate members between connecting rod and rotor discs may also be employed for gas turbines of the double-shaft type having a respective rotor for compressor and turbine stages. Such use is sensible and advantageous in cases wherein the connecting rod of a compressor or a turbine stage is of such length that the natural frequency thereof is lower than the rotational frequency of the rotor, and oscillation amplitudes of the connecting rod are to be suppressed during operation of the rotor.

Other features which are considered as characteristic for the invention are set forth in the appended claims.

Although the invention is illustrated and described herein as embodied in rotor of disc construction for single-shaft gas turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 3:
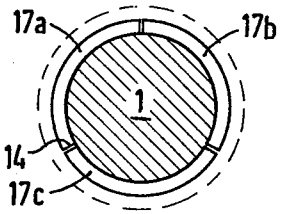
Figure 2A:
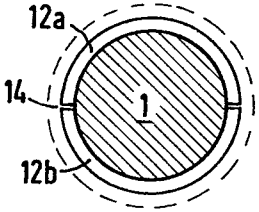
FIG. 2 is a much enlarged fragmentary view of FIG. 1 showing the shells and the clamping rings of the indicated portion A in clearer detail.
Figure 2:
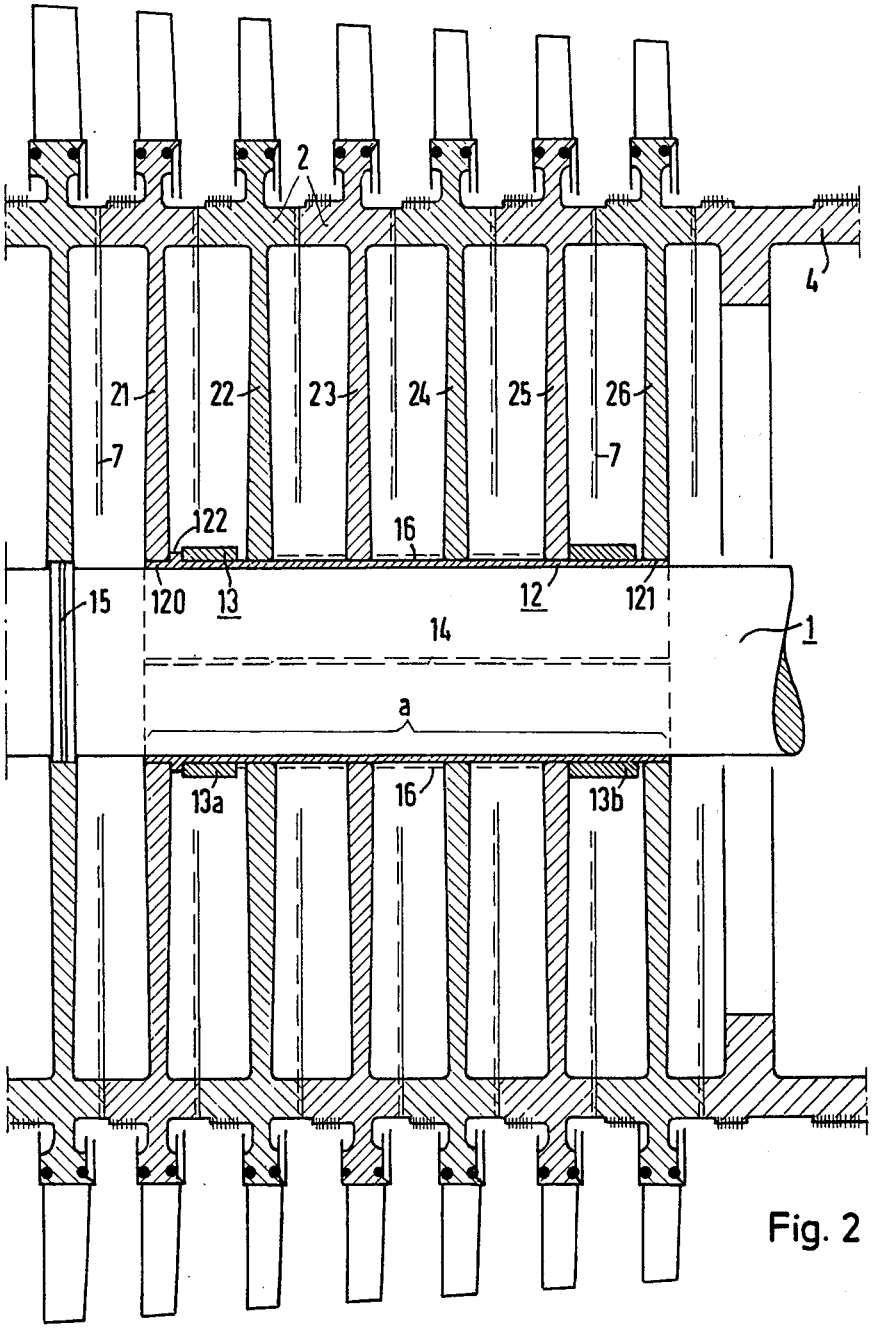

FIG. 2*a* is a cross-sectional view of the rotor shaft connecting rod of FIG. 2 surmounted by the shells; and FIG. 3 is a view similar to that of FIG. 2*a* showing another embodiment of the shells.

Figure 1:
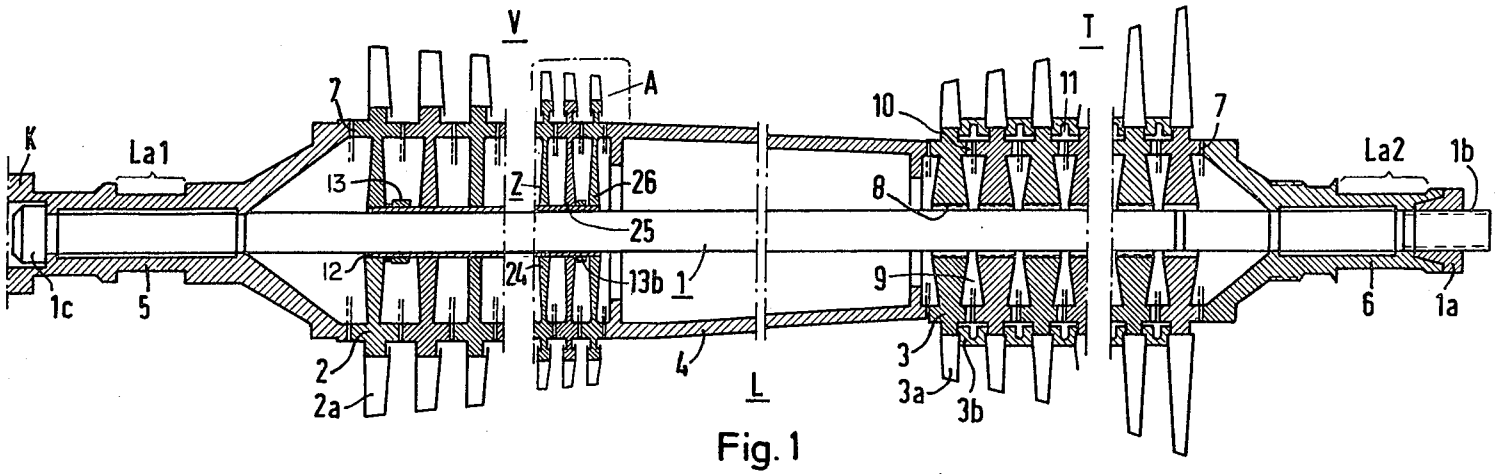
FIG. 1 is a diagrammatic longitudinal sectional view of a rotor for a single-shaft turbine of disc construction provided with shells and clamping rings serving as intermediate members in accordance with the invention.

Referring now to the drawings and first particularly to FIG. 1 thereof, there is shown a rotor L of disc construction for single-shaft gas turbine having a central connecting rod 1 extending centrally through rotor discs 2 of a compressor stage V, rotor discs 3 of a turbine stage T, a hollow shaft part 4 inserted between the compressor stage V and the turbine stage T, as well as shaft butts 5 and 6 mounted at the outer ends of both rotor disc packages 2 and 3, respectively. The foregoing components 2–6 of the rotor of the invention are provided, at annular surfaces thereof which face toward one another, with centering ring gears 7 that are secured against torsion (note the fragmentary view in FIG. 2 of the enlarged portion A shown in FIG. 1).

The ring gears 7 may be provided, for example, with conventional Hirth toothing. After the individual components 2–6 have been strung or mounted on the connecting rod 1 coaxially and concentrically therewith, they are clamped together by a tightening nut 1*a* which is screwed on a thread 1*b* formed on the connecting rod 1. The connecting rod 1, which has a pin head 1*c* formed at the other end thereof with which the end surfaces of a recess formed in the shaft butt 5 are in engagement, is an elastic resilient member so that a large elastic compressive force is exerted in the vicinity of the ring gears 7 on the components 2–6, which assures the fact that the components 2–6 are non-slidably clamped to one another while transmitting torque through the ring gears 7 acting as clutches.

The rotor L is moreover provided with a respective supporting bearing and thrust bearing in the regions L*a*and L*a*2 The thrust bearings can be united into a single double-thrust bearing for both thrust directions or can be provided with a combined supporting-thrust bearing at each rotor end. The bearings as well as the stationary housing portions are not shown in the drawings since they do not constitute part of the invention proper of the instant application. The rotor discs 2 are provided at the outer periphery thereof with respective bucket rings 2*a*, the buckets or blades being form-lockingly inserted by the base or foot portions thereof in suitable axially or peripherally extending grooves. The same construction applies to the rotor discs 3 of the turbine stage T with respect to the turbine buckets or blades 3*a* thereof. However, in addition, intermediate rings 3*b* for guiding coolant air in connection with the cooling of the feet of the buckets or blades are respectively disposed between adjacent rotor discs 3. Part of the air compressed by the compressor stage V passes through the hollow shaft part 4 and through channels located between the inner peripheral surface of the hubs of the rotor discs 3 and the connecting rod 1, and formed by inserts 8, into spaces 9 located between the rotor discs 3. From the spaces 9, the compressed air then travels through radial channels 10 to cooling air chambers 11 located between the bucket rings 3*a* from which it is able to discharge through bucket feet cooling channels into the stage chamber, i.e. outside of the rotor. A coupling flange K is located at one end of the turbine rotor shown in FIG. 1 for coupling thereto a nonillustrated generator as well as turning and starting device.

Tubular intermediate members generally identified by the reference character Z in FIG. 1 are located between the outer periphery of the connecting rod 1 and the inner periphery of the rotor discs 2 which are, in fact, in the illustrated embodiment of FIG. 1, the rotor discs 21–26 (FIG. 2). The intermediate members Z serve for maintaining elastic contact between the connecting rod 1 and the indicated rotor discs 21–26 during operation of the turbine, i.e. when the rotor discs widen somewhat due to the action of centrifugal force. The intermediate members Z, as shown more clearly in FIGS. 2 and 2*a*, are formed of axially separated shells 12*a* and 12*b* surrounding the connecting rod 1, the shells 12*a* and 12*b* being held together by clamping rings generally identified by the reference numeral 13 and braced against the outer periphery of the connecting rod 1.

In FIGS. 2 and 2*a*, two similar shell halves or half-shells 12*a* and 12*b* are shown, which surround the connecting rod 1 with only narrow parting gaps 14 located therebetween, i.e., the shell halves 12*a* and 12*b* are placed about the connecting rod 1 and are then fixed and clamped thereon by the clamping rings 13. For this purpose, two contracting rings 13*a* and 13*b*, which are provided at each end respectively of the shells 12*a* and 12*b* may be employed. In principle, especially for relatively short axial length of the shells 12, one clamping or contracting ring 13 may also suffice; however, the illustrated embodiment employing two such rings is considerably more stable and effective since the axial length *a* of the shells 12 extends over a bucket or blade package having a greater number of rotor discs 2, namely six rotor discs in the embodiment of FIG. 2. Both ends 120, 121 of the shells 12 project through the clamping rings 13*a* and 13*b*, respectively, and are surrounded respectively by the rotor discs 21 and 26 located directly adjacent the respective clamping rings 13*a* and 13*b*. The ends of the shells 12 are thereby definitely fixed.

For the purpose of determining the position of the first clamping ring 13*a* with respect to the first rotor disc 21 of the disc package 21 to 26, the shells 12 are provided with an annular collar 122 that is disposed between the rotor disc 21 and the clamping disc 13*a*. As shown in FIG. 1, the shells 12 with clamping rings 13 are located over half or nearly half the length of the connecting rod 1 and in the vicinity of the first rotor disc 2 of the compressor stage V facing the turbine stage T, that is in that vicinity where the greatest oscillating amplitudes would occur if it were not for the fact that the connecting rod 1 is fixed, as shown in FIGS. 2 and 2*a*. Accordingly, the fixing and damping effect is especially strong there.

In FIG. 2, there is shown a further double-ring collar 15 located at the outer periphery of the connecting rod 1 which permits an accurate snug or sliding fit with respect to the appertaining rotor disc 2 of the compressor stage V. As the broken lines 16 in FIG. 2 illustrate to an exaggerated extent, the shells 12 widen or broaden under the stress of centrifugal force like the staves of a barrel and thereby brace the connecting rod 1 against the rotor discs 2 surrounding the same. On the other hand, the fixed contact at the axial ends of the shells is maintained by the contracting rings 13*a* and 13*b* which are mounted thereon with suitable contracting stress. The contracting rings 13*a* and 13*b* have an additional advantage with respect to the ring halves, which can also be tightened by being screwed, that they are capable of being produced in a relatively simple and inexpensive manner and inherently exhibit no imbalances. In comparison to the attainable compressive force, they have only a very low weight. The compressive force between the connecting rod 1 and the rotor disc surrounding the latter can be optimally adjusted not only through axial length and radial thickness of the shells 12 but also, for example, by dividing the shells into more parts then two halves extending in axial direction, as is illustrated in the embodiment of FIG. 3 of the drawings.

As shown in FIG. 3, three shells 17*a*, 17*b* and 17*c* are provided, which have a moment of resistance with respect to radial bending that is slightly reduced with respect to that of the shell halves shown in FIG. 2*a*.

The shell disposition in FIG. 2 can also be employed for the turbine stage T.

I claim:

1. Rotor of disc construction for at least single-shaft gas turbines having compressor and turbine stages, comprising respective rotor disc packages for the compressor and turbine stages, a hollow shaft located between said compressor and turbine stages, and respective shaft stubs seated at the outer ends of the rotor disc packages at respective meshing centering ring gears secured against torsion, all strung together coaxially, and means for clamping the same together including a connecting rod extending centrally The and tubular 2 members located between the outer periphery of said connecting rod and the inner periphery of said rotor discs for maintaining elastic contact between said connecting rod and said discs during operation of the turbine, said intermediate members comprising axially divided shells surrounding said connecting rod and extending axially coextensively with a plurality of said discs, and at least one clamping ring clamping said shells together and bracing them against the outer periphery of said connecting rod.

2. Rotor according to claim 1 wherein said clamping ring is secured by shrink-fitting on said shells and said connecting rod.

3. Rotor according to claim 1 including two clamping rings, clamping said shells together at respective ends of said shells.

4. Rotor according to claim 1 wherein said tubular intermediate members are formed of two similar shell halves surrounding said connecting rod with only a narrow gap therebetween.

5. Rotor according to claim 1 wherein said shells extend axially along the axial length of a rotor disc package comprising a plurality of rotor discs.

6. Rotor according to claim 1 wherein said shells are disposed over substantially half the length of said connecting rod and in vicinity of the first rotor discs of the compressor stage facing the turbine stage.

7. Rotor according to claim 3 including two clamping rings clamping said shells together adjacent respective ends of said shells, the ends of said shells projecting beyond the respective clamping rings and being surrounded respectively by a rotor disc located directly adjacent the respective clamping ring.

* * * * *

UNITED STATES PATENT AND TRADEMARK OFFICE

CERTIFICATE OF CORRECTION

PATENT NO. : 3,976,399

DATED : August 24, 1976

INVENTOR(S) : Otto Schmoch

It is certified that error appears in the above-identified patent and that said Letters Patent are hereby corrected as shown below:

In the Claims:

Claim 1, line 10, delete "The and tubular 2"

and insert --therethrough; and tubular intermediate--

Signed and Sealed this

Twenty-second Day of March 1977

[SEAL]

*Attest:*

RUTH C. MASON
*Attesting Officer*

C. MARSHALL DANN
*Commissioner of Patents and Trademarks*